United States Patent [19]

Ebmeyer et al.

[11] Patent Number: 4,666,422

[45] Date of Patent: May 19, 1987

[54] APPARATUS FOR ALIGNING A WICKETER STACKING STATION WITH AN EDGE OF A WEB

[75] Inventors: Wilfried Ebmeyer, Enger; Werner Krutemeier, Löhne, both of Fed. Rep. of Germany

[73] Assignee: Windmöller & Hölscher, Lengerich of Westphalia, Fed. Rep. of Germany

[21] Appl. No.: 800,151

[22] Filed: Nov. 20, 1985

[30] Foreign Application Priority Data

Nov. 20, 1984 [DE] Fed. Rep. of Germany ..... 3442420

[51] Int. Cl.[4] ..... B31B 1/00

[52] U.S. Cl. ..... 493/12; 493/10; 493/204; 493/478

[58] Field of Search ..... 493/10, 194, 198, 199, 493/204, 478, 479; 271/195, 196, 197; 414/72

[56] References Cited

U.S. PATENT DOCUMENTS 3,841,142 10/1974 Aisuta et al. ..... 72/448
4,371,365 2/1983 Shingō ..... 493/204
4,451,249 5/1984 de Bin ..... 493/204

FOREIGN PATENT DOCUMENTS 2428113 1/1976 Fed. Rep. of Germany .

*Primary Examiner*—Frederick R. Schmidt
*Assistant Examiner*—Robert Showalter
*Attorney, Agent, or Firm*—Fleit, Jacobson, Cohn & Price

[57] ABSTRACT

Apparatus for aligning a wicketer frame with an edge of a tubular or semitubular plastic web. The positions of the edges of the web are sensed and the wicketer frame is transversely displaced in response to and in dependence on the sensed deviation of the edges of the web from an initial position. The wicketer frame is provided with at least one transverse rail, which is supported on rollers or sliding surfaces of an underlying carrying frame to permit transverse movement of the wicketer frame relative to the web. The wicketer frame is connected by a beam to an end frame, which carries the downstream end of a stacking conveyor and is supported on a base frame. The end frame is longitudinally displaceable and is rotatable through a small angle relative to the base frame. A rack and pinion arrangement is provided for transversely moving the wicketer frame.

6 Claims, 4 Drawing Figures

II
II
1
3
4
5
5
6
7
8
9
10
11
12
13
14
15
18
19
20
24
25

APPARATUS FOR ALIGNING A WICKETER STACKING STATION WITH AN EDGE OF A WEB

BACKGROUND OF THE INVENTION

1. Field of the Invention

This invention relates to apparatus for conveying bags, and more particularly to apparatus for aligning an element of a bag conveying line with an edge of a tubular or semitubular plastic web.

2. Description of the Prior Art

In apparatus for the continuous production of plastic bags, welding stations that sever plastic bags closed by seam welds from tubular or semitubular plastic webs are usually followed by wicketer stacking stations, which include pairs of transfer arms that are provided with suction cups or other gripping means and are arranged to receive the cut bags and then to rotate through 180 degrees to transfer the cut bags onto respective pairs of stacking pins carried by an endless conveyor of a stacking conveyor line, whereby respective stacks of bags are formed on the conveyor. To permit the formation of stacks of several bags on the stacking lines, the bags are provided with suitable locating holes, which are punched into the continuous web before the wicketer stacking station. If the direction of travel of the web deviates laterally from the initial longitudinal direction of the web, the stacking operation will be disrupted because the individual bags which have been severed and provided with seam welds and locating holes cannot be carried over to the stacking conveyor in the correct position by the wicketer transfer arms, and the locating holes will not be properly positioned relative to the stacking pins on the stacking conveyor.

In order to ensure that the bags which have been severed and welded will be transferred by the wicketer transfer arms to the pairs of stacking pins in the proper position, it is known to displace the entire wicketer stacking station and the entire stacking conveyor line in a transverse direction to the extent of the measured deviation of the web so that the locating holes of the bags will receive the pairs of stacking pins. But the transverse displacement of the entire wicketer stacking station and the entire stacking conveyor line requires relatively expensive means and can be effected only slowly because large masses must be moved.

It is known from German Patent Specification No. 24 28 113 that a frame carrying a core for winding a web can be pivotally carried by an intermediate plate, which is guided on a base plate for a transverse displacement. In that arrangement, the frame is provided with drive mean for imparting a pivotal movement to the frame and the intermediate plate is provided with drive means for imparting a transverse movement to the intermediate plate. By means of sensors scanning an edge of the web the drive means can be so controlled that the edge of the web being wound on the core will be properly aligned.

It is an object of the present invention to permit a simpler and more rapid adjustment of the wicketer station and stacking conveyor line in response to a lateral deviation of the web.

SUMMARY OF THE INVENTION

Briefly stated in accordance with one aspect of the present invention, a wicketer frame, in which transfer arms are rotatably mounted, is provided with at least one transverse rail, which is supported on rollers or a sliding surface of a carrying frame. The wicketer frame is connected by a beam to an end frame, which receives the receiving end of the stacking line and is supported on a base frame that is longitudinally displaceable and is rotatable through a small angle relative to the base frame. An actuator is mechanically connected only to the wicketer frame adjacent to the transverse rail and moves the wicketer frame laterally in response to signals received from web sensors positioned upstream of the wicketer. The apparatus in accordance with the present invention permits a fast adjustment of the wicketer stacking station and the stacking line in response to a lateral deviation of the web because only the wicketer frame is transversely displaced to the extent of the deviation. During displacement, the wicketer frame also undergoes a slight rotation about a pivotal axis disposed adjacent to the end frame so that the desired adjustment in response to the deviation of the web is effected merely by the transverse displacement of the wicketer frame.

DESCRIPTION OF THE PREFERRED EMBODIMENT

An illustrative embodiment of the invention will now be explained in more detail with reference to the drawings.

Figure 1:
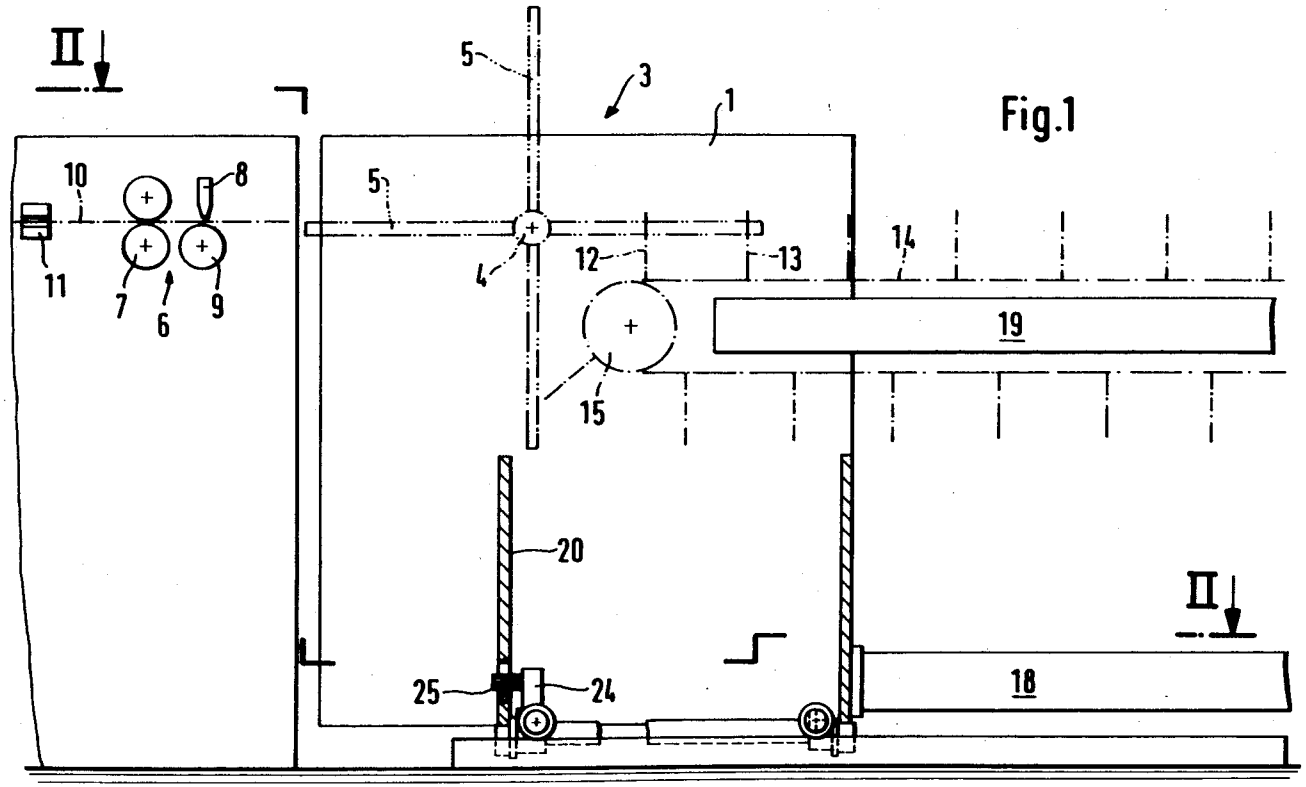
FIG. 1 is a fragmentary side elevational view, partly in section, of bag handling apparatus in accordance with the present invention including a wicketer frame, a part of an upstream transverse welding apparatus, and a part of a downstream stacking conveyor.
Figure 2:
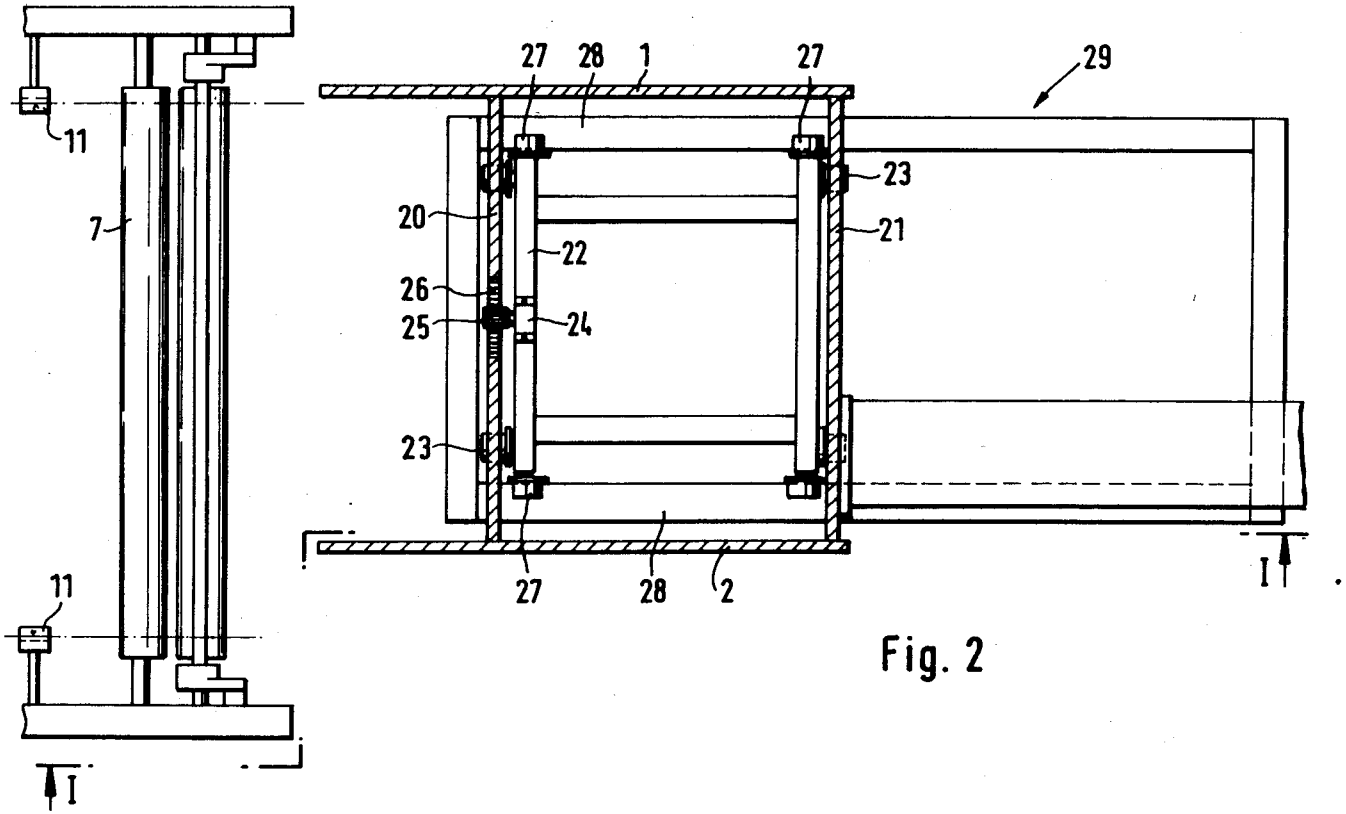
FIG. 2 is a cross-sectional view taken along the line II—II of FIG. 1.

Referring now to FIGS. 1 and 2, a wicketer frame 3 supports a wicketer 3' that includes a shaft 4 from which pairs of laterally spaced radial arms 5 extend. Wicketer frame 3 is defined by upstanding side panels 1, 2, in which shaft 4 is rotatably mounted. The shaft 4 carries radially extending transfer arms 5, which are provided in laterally spaced pairs and carry suction cups or other gripping means to grip bags that are cut from a web of material and to transfer the cut bags from a severing apparatus 6 to a stacking conveyor 12' by rotation of wicketer 3' through approximately 180° and in a clockwise direction as viewed in FIG. 1.

Positioned immediately upstream of the wicketer frame 3 is severing and welding station 6, which includes an intermittently driven pair of feed rollers 7, 7' for advancing a tubular or semitubular plastic web 10 in intermittent steps corresponding to the width or length of a bag. The welding apparatus includes an upper welding bar 8, which is adapted to be lifted and lowered relative to a lower welding roller 9. Welding bar 8 is provided with a knife edge (not shown) for cutting the bags from the web, and lower welding roller 9 serves as a backup surface in cooperation with welding bar 8 to permit a transverse weld to be made in web 10.

Feed rollers 7, 7' are preceded by a pair of transversely spaced web position sensors 11, which are positioned to scan respective side edges of the web. The sensors are preceded by a punching means (not shown)

which punches spaced pairs of locating holes along an edge portion of the web at a predetermined spacing inwardly of the edge. Each of the sensors 11 can be fixed in position transversely relative to web 10 and can be an optical sensor including a plurality of transversely positioned light sources and photocells, or the like, positioned in opposite sides of the web for sensing the direction and the extent of transverse movement of web 10 relative to an initial position. Other web sensing means can also be used, as will be understood by those skilled in the art, so long as they can detect the presence and absence of the edges of the web if the web were to shift in a transverse direction, and provide signals indicative of the direction and extent of transverse web movement relative to an initial position.

The center-to-center spacing of the locating holes lengthwise of the web is equivalent to the center-to-center spacing of a pair of stacking pins 12, 13 carried by a stacking conveyor 12', that extends downstream from wicketer frame 3. The stacking pins 12, 13 are preferably each mounted on separate plates that are carried by an endless conveyor 14, which can be a chain or a cogged belt. Conveyor 14 passes around a forward sprocket 15, which is rotatably carried on a shaft (not shown) mounted in the wicketer frame 3, and around a rear drive sprocket 16 (see FIG. 3), which is rotatably carried on a shaft (not shown) mounted in an end frame 17, and which is driven by a suitable motor 33, or the like, for intermittently moving stacking conveyor 12'.

Wicketer frame 3 is connected to end frame 17 by a longitudinally extending rigid beam 18. A central beam 19 forming part of the structure of stacking conveyor 12' is also connected to wicketer frame 3 and to end frame 17 to provide an additional connection between the two frames 3 and 17 for increased rigidity. The connection between beam 19 and frames 3 and 17 can be any suitable connection means, as will be known to those skilled in the art.

As best seen in FIG. 2, side panels 1, 2 of wicketer frame 3 are interconnected by crossbeams 20, 21, the lower edge portions of each of which define transverse rails, each of which is supported on the peripheries of two pairs of cylindrical rollers 23, spaced transversely and longitudinally relative to wicketer frame 3. Rollers 23 are rotatably carried in respective cross members 22, 22' of a rectangular carrying frame 23' for rotation about horizontal axes, which are parallel to the longitudinal direction of the stacking conveyor 12'. Carrying frame 23' includes cross members 22, 22' and longitudinal members **23*a*, 23*b* all of which members are interconnected as shown in FIG. 2 to define frame 23'**.

A pinion 25 is carried on a shaft (not shown) that is rotatably carried by cross member 22 and can be driven by a stepping motor 25' through a gear train 24. Pinion 25 is in meshing engagement with a rack 26, which is provided in an elongated opening 20' (see FIG. 1) in crossbeam 20, and that extends transversely relative to wicketer frame 3. Rack 26 extends in a direction parallel to the lower edge of cross beam 20.

Cross members 22, 22' of the carrying frame each include pairs of rollers 27, which are rotatably carried at each end of cross members 22, 22' for rotation about axes that extend transversely relative to wicketer frame 3. Rollers 27 are guided on rails 28, 28' which extend outwardly from wicketer frame 3 in a longitudinal direction parallel to stacking conveyor 12', and form a part of a wicketer base frame 29.

Figure 3:
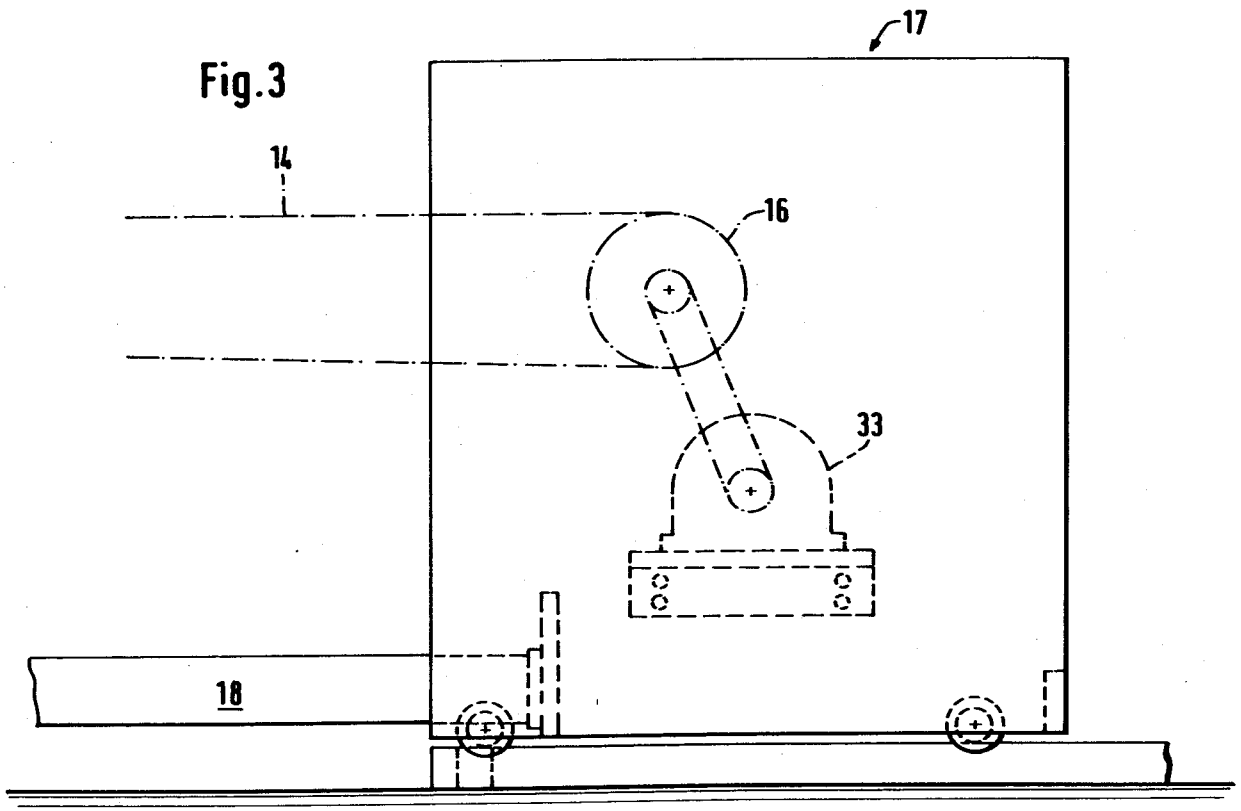
FIG. 3 is a fragmentary side elevational view of an end frame of the stacking conveyor.
Figure 4:
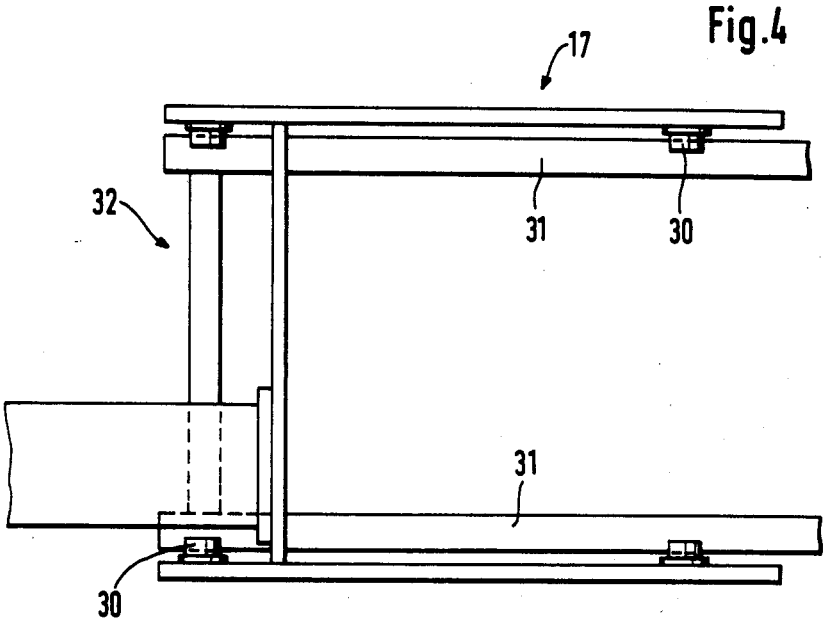
FIG. 4 is a fragmentary plan view of the end frame of FIG. 3.

Referring now to FIGS. 3 and 4, end frame 17 includes four rollers 30, which are rotatably carried along the lowermost edges of a pair of spaced, opposed end panels 17', and are mounted for rotation about transverse axes. Rollers 30 bear against and are guided on rails 31, which form part of an end base frame 32.

In operation, severing and welding station 6, wicketer frame 3, stacking conveyor 12' and end frame 17 for stacking conveyor 12' are initially aligned relative to each other in that sequence. The operation of the the apparatus involves welding and severing bags from web 10 at welding station 6, and transferring the welded and severed bags by wicketer 3' from welding station 6 to stacking conveyor 12', which is maintained stationary, with the bags positioned on stacking conveyor 12' so that stacking pins 12, 13 are received in the locating holes that are punched through the bags. When the desired number of bags has been received and deposited on a pair of stacking pins 12, 13, stacking conveyor 12' is incrementally advanced by motor 33 to present the next pair of stacking pins adjacent the downstream end of wicketer 3' so that another stack of bags can be formed.

When web position sensors 11 detect a transverse deviation of the web 10 from a predetermined position, relative to severing and welding station 6, the sensors provide signals to a suitable control device (not shown) that initiates the operation of stepping motor 25' so that the wicketer frame 3 is moved transversely relative to carrying frame 23' and to severing and welding station 6 by engagement of pinion 25 with rack 26. The movement of wicketer frame 3 is in a direction and in an amount responsive to the sensor signals indicative of the direction and amount of transverse deviation of web 10, in order to restore proper transverse alignment of the wicketer 3' relative to the web so that the bags are properly positioned relative to stacking conveyor 12', and the stacking pins extend through the holes in the bags. Operation of stepping motor 25 can be continued until frame 3 is shifted transversely in the direction and in the amount of deviation of web 10 as sensed by sensors 11.

During transverse displacement of wicketer frame 3, both the wicketer frame and the stacking conveyor are rotated through a small angle about end frame 17, which itself rotates slightly but is not moved transversely to the same extent as is wicketer frame 3. End frame 17 can perform such a rotational movement because it is supported by rollers 30 that, in turn, are supported by the rails of the base frame 32, and rollers 30 are capable of only small transverse movement relative to rails 31.

By means which are not shown, the means for punching the locating holes in the bags are also readjusted to compensate for the measured deviation of the web so that a predetermined distance from the locating holes to the edge of the web 10 will be maintained.

Although particular embodiments of the present invention have been illustrated and described, it will be apparent to those skilled in the art that various changes and modifications can be made without departing from the spirit of the present invention. For example, transverse displacement of the wicketer frame can be effected by a fluid operable piston-cylinder unit, if desired. It is intended to cover in the appended claims all such changes and modifications that fall within the scope of the present invention.

What is claimed is:

1. Apparatus for adjusting the transverse position of a wicketer frame relative to an edge of a tubular or semi-tubular plastic web having locating holes and from which web bags are formed at a severing and welding station, and are received by a rotatable wicketer carried by the wicketer frame to transfer the bags from the severing and welding station to a stacking conveyor having stacking pins to receive the locating holes of the bags, said apparatus comprising:

(a) a wicketer frame having supporting means for supporting the wicketer frame, said supporting means including a wicketer carrying frame for carrying the wicketer frame longitudinally relative to the direction of web movement;

(b) at least one transversely extending rail on said wicketer frame and in contact with and movable transversely relative to said support means;

(c) a stacking conveyor extending longitudinally relative to and adjacent said wicketer frame, said stacking conveyor including an end frame for receiving and supporting a downstream end of said stacking conveyor;

(d) connecting means extending from and rigidly interconnecting said wicketer frame and said end frame;

(e) a base frame for supporting said end frame for longitudinal displacement relative to said web and for rotation through a small angle relative to the direction of movement of the web;

(f) sensing means positioned upstream of said wicketer frame for sensing a transverse movement in the position of an edge of the web and for providing a signal indicative of transverse web movement; and (g) actuator means carried by said support means and responsive to said web movement signal for transversely displacing the wicketer frame in dependence on the sensed transverse movement of the edge of the web and for simultaneously rotating said end frame through a small angle relative to said base frame, said actuator means in engagement with said transversely extending rail.

2. Apparatus according to claim 1, wherein said wicketer frame includes a rack and said actuator means includes a pinion and a motor for driving said pinion, said pinion being in meshing engagement with said rack for moving said wicketer frame transversely relative to said supporting means.

3. Apparatus according to claim 1, wherein said apparatus includes a wicketer base frame including rails that extend substantially parallel to the direction of web movement and said wicketer carrying frame includes rollers that roll along said rails for longitudinal movement of said wicketer frame.

4. Apparatus according to claim 1, wherein said connecting means includes a longitudinally extending central beam supporting the stacking conveyor.

5. Apparatus according to claim 1, wherein said base frame of said end frame includes longitudinally extending rails and said end frame is supported on rollers that roll along said longitudinally extending rails of said end base frame.

6. Apparatus according to claim 1, wherein said wicketer carrying frame includes rollers having axes of rotation that extend longitudinally, and said wicketer frame rail is supported on and movable along said rollers.

* * * * *